US006861941B2

(12) United States Patent
Kuriyama

(10) Patent No.: US 6,861,941 B2
(45) Date of Patent: Mar. 1, 2005

(54) CHIP RESISTOR

(75) Inventor: Takahiro Kuriyama, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 10/776,846

(22) Filed: Feb. 11, 2004

(65) Prior Publication Data

US 2004/0160303 A1 Aug. 19, 2004

(30) Foreign Application Priority Data

Feb. 18, 2003 (JP) ..... 2003-039963

(51) Int. Cl.[7] ..... H01C 1/012
(52) U.S. Cl. ..... 338/309; 338/313; 338/332
(58) Field of Search ..... 338/309, 313, 338/332

(56) References Cited

U.S. PATENT DOCUMENTS 6,359,546 B1 * 3/2002 Oh ..... 338/313
6,492,896 B2 * 12/2002 Yoneda ..... 338/309
6,703,683 B2 * 3/2004 Tanimura ..... 257/536

FOREIGN PATENT DOCUMENTS

JP 8-236302 9/1996
JP 2002-184602 6/2002

* cited by examiner

*Primary Examiner*—Karl D. Easthom
(74) *Attorney, Agent, or Firm*—Merchant & Gould P.C.

(57) ABSTRACT

A chip resistor including an elongated chip substrate, a resistive layer formed on the substrate, a silver-containing upper electrode connected to the resistive layer, an undercoat enclosing the resistive layer and extending onto part of the upper electrode, an auxiliary electrode connected to the upper electrode and extending onto part of the undercoat, and overcoat enclosing the undercoat and extending onto part of the auxiliary electrode. In the longitudinal direction of the substrate The undercoat extends longitudinally of the substrate beyond the overcoat, so that the extremity of the undercoat is offset from the extremity of the overcoat by an appropriate distance.

7 Claims, 3 Drawing Sheets

CHIP RESISTOR

BACKGROUND OF THE INVENTION

1. Field of the Invention

The present invention relates to a resistor of the type including an insulating chip substrate provided with at least one resistive layer, a pair of upper electrodes connected to the resistive layer, and a protection coat enclosing the resistive layer.

2. Description of the Related Art

In a conventional chip resistor of the above-described type, the protection coat tends to be made higher at the center of the upper surface of the chip substrate in comparison with the upper electrodes. Due to this uneven surface configuration, the conventional resistor can suffer several drawbacks. For instance, the chip resistor may fail to be picked up by a suction collet when it needs to be transferred from one place to another. As another example, the protection coat may be broken by allowing the suction collet to come into contact with the projecting portion of the coat.

Further, the conventional chip resistor may suffer the corrosion and the resultant breakage of the upper electrodes when these electrodes are made from a conductive paste containing silver for its main ingredient (the paste is referred to as a "silver paste" hereinbelow). Specifically, the air surrounding the chip resistor may contain sulfur compounds such as hydrogen sulfide gas ($H_2S$). Affected by the gas, the upper electrodes are corroded, whereby the electrical connection can be completely broken.

To address the above problems, Japanese Patent Application Laid-open No. H08-236302 and No. 2002-184602, for example, propose an arrangement whereby an auxiliary electrode is additionally formed on each of the upper electrodes in a manner such that the auxiliary electrode extends onto part of the protection coat. (Thus, the contact portion between the auxiliary electrode and the protection coat is located above the upper electrode).

With this arrangement, the protection coat can be generally flush with each of the two-layered electrodes (i.e., the upper electrode and the auxiliary electrode), or the difference in height between the coat and the electrodes is made smaller. Accordingly, the chip resistor can be more easily picked up by a suction collet, and further, the corrosion of the upper electrodes due to the sulfur compounds in the air can be prevented since the upper electrodes are hidden under the auxiliary electrodes.

However, the teachings of the two Japanese patent applications mentioned above have been found ineffective in preventing the corrosion in the upper electrodes. According to the teaching of JP H08-236302, the auxiliary electrodes are made from a silver paste. Thus, the corrosion due to the airborne sulfur compounds will occur at the contact portion between the auxiliary electrode and the protection coat. Eventually the corrosion expands to damage the upper electrode.

According to the teaching of JP 2002-184602, on the other hand, the auxiliary electrodes are made not from a silver paste but from a nickel paste. In this case, the problem is that the contact portion of the auxiliary electrode with the protection coat is relatively thin, and therefore tends to be broken easily. When breakage occurs in the auxiliary electrode, the airborne sulfur compounds can penetrate through it, and corrodes the silver-containing upper electrode below.

SUMMARY OF THE INVENTION

The present invention has been proposed under the circumstances described above. It is therefore an object of the present invention to provide a chip resistor whose upper electrodes are protected from corrosion.

According to the present invention, there is provided a chip resistor comprising: an insulating substrate including two side surfaces spaced from each other in a predetermined direction and an upper surface extending between the two side surfaces; a resistive layer formed on the upper surface of the substrate; an upper electrode made from a silver paste and connected to the resistive layer; an undercoat enclosing the resistive layer and extending onto part of the upper electrode, the undercoat including an extremity located on the upper electrode; an auxiliary electrode connected to the upper electrode and extending onto part of the undercoat; and an overcoat enclosing the undercoat and extending onto part of the auxiliary electrode, the overcoat including an extremity located on the auxiliary electrode. As viewed in the predetermined direction (i.e., the direction in which the two side surfaces of the substrate are spaced from each other), the undercoat extends beyond the extremity of the overcoat, so that the extremity of the undercoat is offset from the extremity of the overcoat by an appropriate distance. Preferably, this distance may be 100 $\mu$m or more.

The auxiliary electrode can be made from a silver-containing conductive paste. Preferably, the auxiliary electrode may be made from a base metal paste containing no silver or a carbon paste.

Other features and advantages of the present invention will become apparent from the detailed description given below with reference to the accompanying drawings.

DETAILED DESCRIPTION OF THE PREFERRED EMBODIMENTS

Preferred embodiments of the present invention will be described below with reference to the accompanying drawings.

Figure 1:
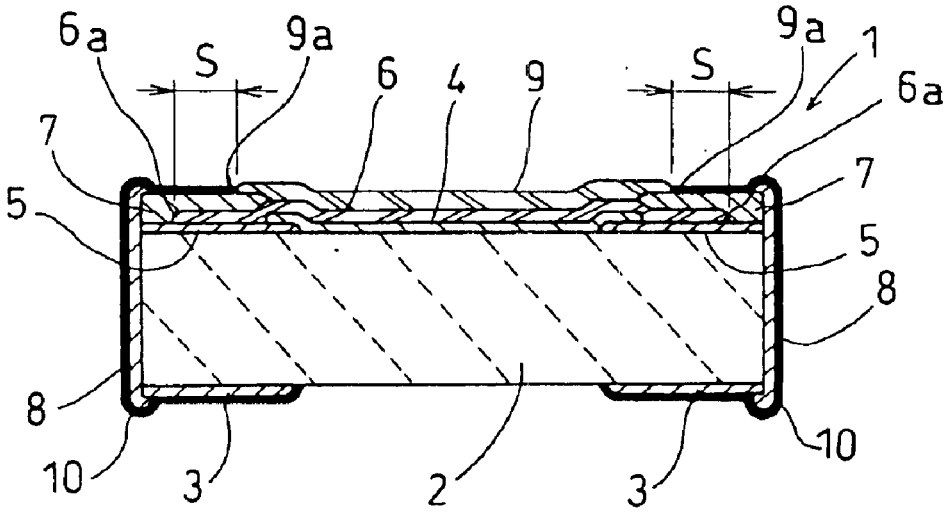
FIG. 1 is a sectional view showing a chip resistor according to the present invention.

FIG. 1 shows in section a chip resistor 1 according to the present invention. The resistor 1 includes an insulating substrate 2 having a lower surface and an upper surface. The lower surface of the substrate 2 is provided with a pair of lower electrodes 3 made from a silver paste. The upper surface of the substrate 2 is provided with a resistive layer 4 and a pair of upper electrodes 5 connected to the intermediate resistive layer 4. The upper electrodes 5 are made from a silver paste as the lower electrodes 3. The resistive layer 4 is covered by an undercoat 6 made of e.g. glass. The undercoat 6 extends over the resistive layer 4 and further onto the right and left upper electrodes 5, thereby overlapping part of each upper electrode 5.

The resistor 1 further includes a pair of auxiliary upper electrodes 7 and a pair of side electrodes 8. Each of the auxiliary electrodes 7, made of e.g. a silver paste, is connected to the relevant one of the upper electrodes 5 and overlaps an end portion of the undercoat 6, as shown in FIG. 1. The side electrodes 8 are formed on the right or left side surface 2*a* of the substrate 2 (see FIG. 2), to be connected to the lower electrode 3 and the auxiliary upper electrode 7. Preferably, each side electrode 8 comes into direct contact with the upper electrode 5 as well as the auxiliary electrode 7 to establish a more reliable electrical connection.

As shown in FIG. 1, the undercoat 6 has an inner area that is covered by an overcoat 9 made of e.g. glass or heat-resistant synthetic resin. The overcoat 9 extends onto part of each auxiliary electrode 7.

The undercoat 6 has right and left extremities 6*a* located on the upper electrodes 5. Likewise, the overcoat 9 has right and left extremities 9*a* located on the auxiliary electrodes 7. According to the preferred embodiment, as viewed laterally in FIG. 1, the undercoat 6 is longer than the overcoat 9 (in other words, the undercoat 6 extends beyond the overcoat 9), so that the right extremity 6*a* of the undercoat 6 is offset to the right from the right extremity 9*a* of the overcoat 9 by a distance S, and that the left extremity 6*a* of the undercoat 6 is offset to the left from the left extremity 9*a* of the overcoat 9 by the same distance S. Thus, the extremities 6*a* of the undercoat 6 are closer to the side surfaces 2*a* of the substrate 2 than the extremities 9*a* of the overcoat 9 are.

The lower electrodes 3, the auxiliary electrodes 7 and the side electrodes 8 are plated with a metal coating 10, as shown in FIG. 1. The metal coating 10 has a double-layer structure consisting of an undercoat of nickel (Ni) and an overcoat of tin (Sn) or solder for facilitating soldering.

In the arrangement shown in FIG. 1, the undercoat 6 extends beyond the extremity 9*a* of the overcoat 9 by a suitable distance S (>0), thereby insulating the upper electrode 5 from the contact portion between the auxiliary electrode 7 and the overcoat 9. Therefore, even when the contact portion is corroded, the corrosion does not reach the upper electrode 5. Since the upper electrode 5 is not corroded, the thickness of the electrode 5 can be smaller than the thickness of the conventional electrodes. For ensuring reliable insulation of the upper electrode 5, the distance S is no smaller than 100 $\mu$m, for example.

Further, even when breakage occurs at the extremity 9*a* or in the nearby portion of the overcoat 9, the sulfur compounds in the air may enter into the crack, but can never reach the upper electrode 5 due to the insulating extension of the undercoat 6 beyond the extremity 9*a* of the overcoat 9.

The chip resistor 1 described above may be produced by the following process.

Figure 2:
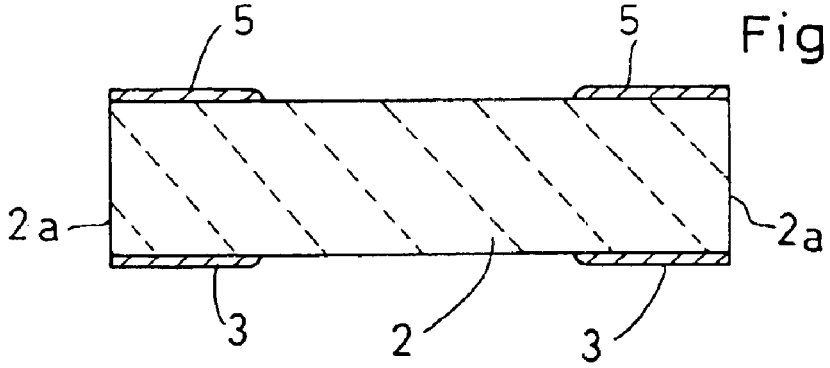
FIG. 2 shows the first step of the process of making the chip resistor shown in FIG. 1.

First, as shown in FIG. 2, a pair of lower electrodes 3 and a pair of upper electrodes 5 are formed on an insulating substrate 2. Each electrode may be made by screen-printing a silver paste onto the prescribed portion of the substrate 2 and then baking the applied paste. The lower electrodes 3 may be formed earlier than the upper electrodes 5, or the upper and lower electrodes may be formed simultaneously.

Figure 3:
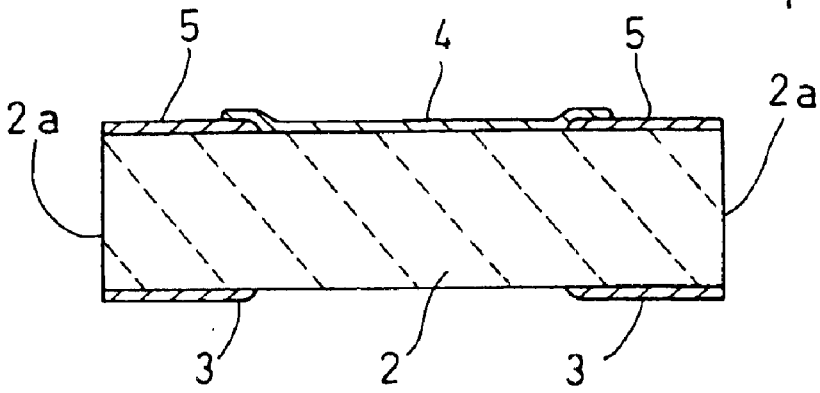
FIG. 3 shows the second step of the process of making the chip resistor.

Then, as shown in FIG. 3, a resistive layer 4 is formed on the upper surface of the substrate 2 in a manner such that the layer 4 bridges between the two upper electrodes 5. The resistive layer 4 may be made by screen-printing a material paste onto the prescribed portion of the substrate 2 and then baking the applied paste. Though not shown in the figure, the resistive layer 4 is subjected to trimming for resistance adjustment.

Figure 4:
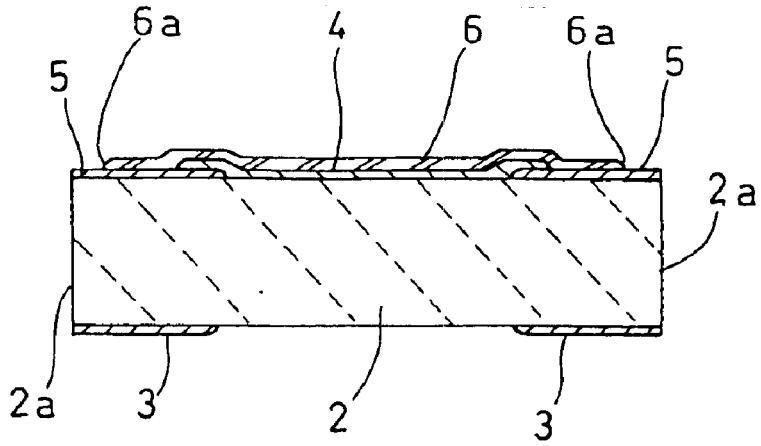
FIG. 4 shows the third step of the process of making the chip resistor.

Then, as shown in FIG. 4, an undercoat 6 is formed on the substrate 2 to enclose the resistive layer 4 and overlap the respective upper electrodes 5 (part of each upper electrode 5 is left uncovered). The undercoat 6 may be made by screen-printing a glass paste and baking the applied paste at the softening temperature of the glass.

Figure 5:
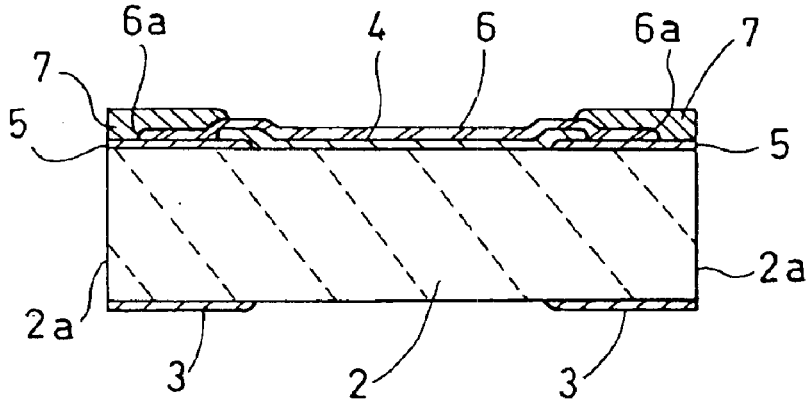
FIG. 5 shows the fourth step of the process of making the chip resistor.

Then, as shown in FIG. 5, an auxiliary electrode 7 is formed on each of the upper electrodes 5 in a manner such that the electrode 7 overlaps the undercoat 6. The auxiliary electrodes 7 may be made by screen-printing a silver paste and baking the applied paste.

Figure 6:
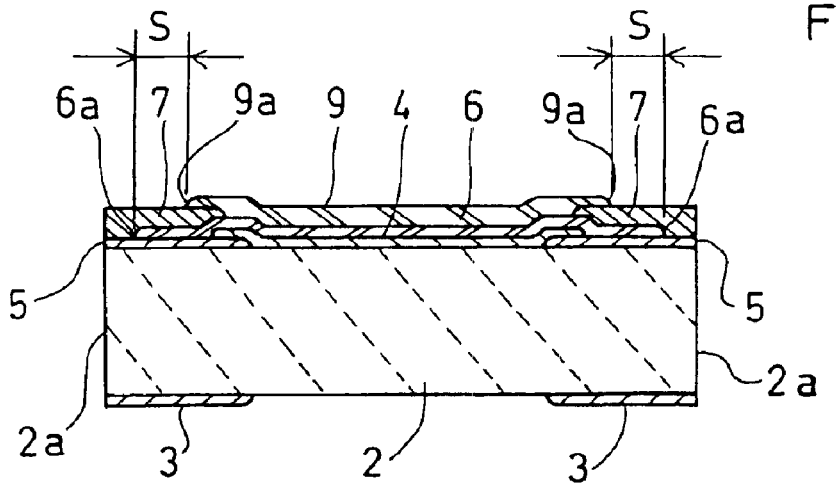
FIG. 6 shows the fifth step of the process of making the chip resistor.

Then, as shown in FIG. 6, an overcoat 9 is formed on the exposed portion of the undercoat 6 in a manner such that the overcoat 9 overlaps the respective auxiliary electrodes 7. Each of the extremities 9*a* of the overcoat 9 is spaced inwardly from the closer extremity 6*a* of the undercoat 6 by the prescribed distance S. The overcoat 9 may be made by screen-printing a glass paste and baking the applied paste at the softening temperature of the glass.

Figure 7:
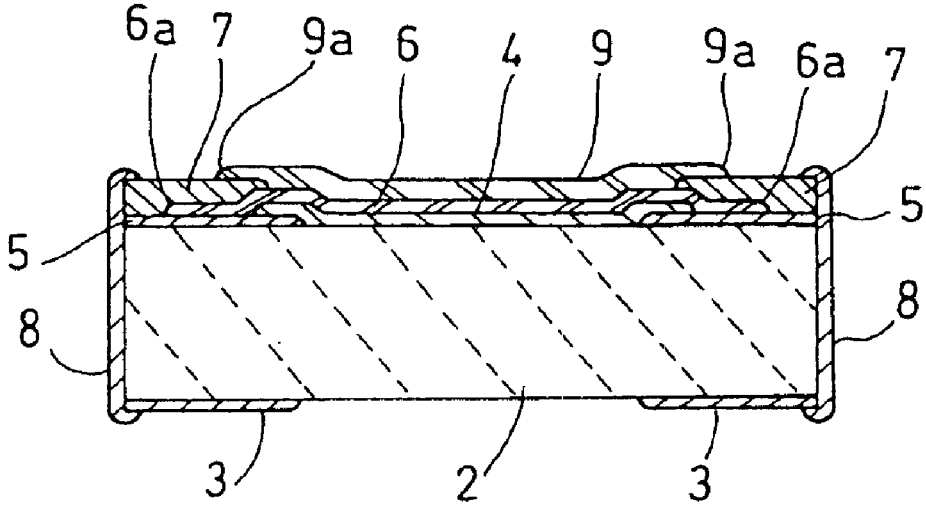
FIG. 7 shows the sixth step of the process of making the chip resistor.

Then, as shown in FIG. 7, a side electrode 8 is formed on each of the side surfaces 2*a* of the substrate 2 to be connected to the lower electrode 3 and the auxiliary electrode 7 (preferably, to the upper electrode 5 as well). The side electrodes 8 may be made by screen-printing a silver paste and baking the applied paste.

Finally, the lower electrodes 3, the auxiliary electrodes 7 and the side electrodes 8 are plated with a metal coating 10 (see FIG. 1).

According to the present invention, the overcoat 9 may be made of a heat-resistant synthetic resin. In this case, the overcoat 9 is formed after the side electrodes 8 are made and before the metal coating 10 is made. The resin overcoat 9 is made by screen-printing an appropriate resin material and heating the applied resin to harden it.

In another embodiment, the auxiliary electrodes 7 may be formed from a "base metal paste" (a conductive paste containing a base metal such as nickel and copper for its main ingredient) or a "carbon paste" (a conductive paste containing carbon powder). Advantageously, the auxiliary electrodes 7, made from a base metal paste or carbon paste, are not corroded by the airborne sulfur compounds.

When use is made of a carbon paste for making the auxiliary electrodes 7, the following steps are performed. Referring to FIG. 5, the carbon paste is applied by screen printing and the applied paste is heated for hardening. Then, as shown in FIG. 6, the overcoat 9 is made by screen-printing a heat-resistant synthetic resin and heating the applied resin for hardening. Then, as shown in FIG. 7, the side electrodes 8 are made by screen-printing a carbon paste and heating the applied paste for hardening. Finally, the metal coat 10 is made by plating.

The present invention being thus described, it is obvious that the same may be varied in many ways. Such variations are not to be regarded as a departure from the spirit and scope of the present invention, and all such modifications as would be obvious to those skilled in the art are intended to be included within the scope of the following claims.

What is claimed is:

1. A chip resistor comprising:

an insulating substrate including two side surfaces spaced from each other in a predetermined direction and an upper surface extending between the two side surfaces;

a resistive layer formed on the upper surface of the substrate;

an upper electrode connected to the resistive layer and extending toward a respective one of the side surfaces of the insulating substrate;

an undercoat enclosing the resistive layer and extending onto part of the upper electrode, the undercoat including an extremity located on the upper electrode;

an auxiliary electrode connected to the upper electrode and extending onto part of the undercoat; and an overcoat enclosing the undercoat and extending onto part of the auxiliary electrode, the overcoat including an extremity located on the auxiliary electrode;

wherein the undercoat extends in the predetermined direction beyond the extremity of the overcoat, so that the extremity of the undercoat is offset from the extremity of the overcoat by a predetermined distance, the extremity of the undercoat being located closer to said respective side surface of the insulating substrate than it is to the extremity the overcoat.

2. The chip resistor according to claim 1, wherein the predetermined distance is no smaller than 100 $\mu$m.

3. The chip resistor according to claim 1, wherein the auxiliary electrode is made from a base metal paste containing no silver.

4. The chip resistor according to claim 2, wherein the auxiliary electrode is made from a base metal paste containing no silver.

5. The chip resistor according to claim 1, wherein the auxiliary electrode is made from a carbon paste.

6. The chip resistor according to claim 2, wherein the auxiliary electrode is made from a carbon paste.

7. A chip resistor comprising:

an insulating substrate including two side surfaces spaced from each other in a predetermined direction and an upper surface extending between the two side surfaces;

a resistive layer formed on the upper surface of the substrate;

an upper electrode made from a silver paste and connected to the resistive layer;

an undercoat enclosing the resistive layer and extending onto part of the upper electrode, the undercoat including an extremity located on the upper electrode;

an auxiliary electrode connected to the upper electrode and extending onto part of the undercoat; and an overcoat enclosing the undercoat and extending onto part of the auxiliary electrode, the overcoat including an extremity located on the auxiliary electrode;

wherein the undercoat extends in the predetermined direction beyond the extremity of the overcoat, so that the extremity of the undercoat is offset from the extremity of the overcoat by a predetermined distance of no smaller than 100 $\mu$m.

* * * * *